US008672446B2

(12) United States Patent
Noda

(10) Patent No.: US 8,672,446 B2
(45) Date of Patent: Mar. 18, 2014

(54) IMAGE FORMING APPARATUS INCLUDING RECORDING HEAD FOR EJECTING LIQUID DROPLETS

(75) Inventor: Hiroshi Noda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 32 days.

(21) Appl. No.: 13/558,827

(22) Filed: Jul. 26, 2012

(65) Prior Publication Data

US 2013/0038650 A1 Feb. 14, 2013

(30) Foreign Application Priority Data

Aug. 11, 2011 (JP) ..... 2011-176267

(51) Int. Cl.
*B41J 2/165* (2006.01)

(52) U.S. Cl.
USPC ..... 347/30

(58) Field of Classification Search
CPC ..... B41J 2/16508; B41J 2/16526
USPC ..... 347/9, 10, 19, 20, 23, 29, 30
See application file for complete search history.

(56) References Cited

U.S. PATENT DOCUMENTS

| | | | | |
|---|---|---|---|---|
| 7,455,386 | B2 * | 11/2008 | Ito | 347/35 |
| 8,430,479 | B2 * | 4/2013 | Nishida | 347/29 |
| 2005/0270318 | A1 | 12/2005 | Noda | |
| 2007/0097163 | A1 | 5/2007 | Shingyohuchi et al. | |

FOREIGN PATENT DOCUMENTS

| | | |
|---|---|---|
| JP | 2007-118317 | 5/2007 |
| JP | 2010-76204 | 4/2010 |

* cited by examiner

*Primary Examiner* — An Do
(74) *Attorney, Agent, or Firm* — Cooper & Dunham LLP

(57) ABSTRACT

An image forming apparatus includes a suction controller to seal a nozzle face of a recording head with a cap and drives a suction device to suck liquid from the head to perform sucking operation. The dummy ejection controller ejects, from the head, droplets not contributing to image formation to perform dummy ejection. The first tinier measures a first elapsed time after the dummy ejection. The second timer measures a second elapsed time after the sucking operation. A liquid discharge amount of the sucking operation is set to be greater than that of the dummy ejection. When the first elapsed time is equal to or greater than a first threshold time, the dummy ejection controller performs the dummy ejection. When the second elapsed time is equal to or greater than a second threshold time which is greater than the first threshold time, the suction controller performs the sucking operation.

8 Claims, 8 Drawing Sheets

FIG. 9

| TOTAL EXECUTED OPERATION | LESS THAN FIRST THRESHOLD | NOT LESS THAN FIRST THRESHOLD AND LESS THAN SECOND THRESHOLD | NOT LESS THAN SECOND THRESHOLD AND LESS THAN THIRD THRESHOLD | NOT LESS THAN THIRD THRESHOLD |
|---|---|---|---|---|
| POWER ON | — | FIRST DUMMY EJECTION | FIRST DUMMY EJECTION<br>SECOND DUMMY EJECTION | FIRST DUMMY EJECTION × 2<br>SECOND DUMMY EJECTION<br>CLEANING |
| POWER OFF | — | FIRST DUMMY EJECTION | SECOND DUMMY EJECTION | CLEANING |

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-176267, filed on Aug. 11, 2011 in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus is known that uses a recording head (liquid ejection head or liquid-droplet ejection head) for ejecting droplets of ink.

Such an image forming apparatus may have a maintenance device (maintenance-and-recovery device) to maintain and recover the ejection stability of nozzles of the recording head. Maintenance and recovery operation includes, for example, suction recovery operation of sucking and discharging liquid from the nozzles of the recording head by driving a suction device with a nozzle face of the recording head sealed with a suction cap, pressurizing recovery operation of pressurizing and supplying liquid to the recording head to discharge liquid from the nozzles of the recording head, and dummy ejecting operation of ejecting liquid droplets not contributing to image formation (dummy ejection droplets) to a dummy ejection receptacle or the suction cap.

Conventionally, for example, JP-2007-118317-A proposes a maintenance and recovery method to perform any cleaning operation of normal flushing of ejecting ink from nozzles, minute-amount flushing of ejecting a smaller amount of ink from nozzles than normal flushing, and sucking ejection of ejecting ink from nozzles by sucking ink. For the maintenance and recovery method, an elapsed time after the end of cleaning operation is measured with a timer, and when the elapsed time measured with the timer reaches a predetermined time, minute-amount flushing is performed and the timer is reset to reduce the amount of liquid (ink) consumed by repeating normal flushing and/or sucking ejection when the standby state of the apparatus continues for a long time.

However, for the configuration proposed in JP-2007-118317-A, when the apparatus is in standby state with the apparatus powered on, minute-amount flushing is repeatedly performed each time the predetermined time passes. As a result, it is necessary to eject an amount of droplets sufficient to recover nozzle conditions of the recording head by minute-amount flushing, thus resulting in insufficient reduction effect of the amount of liquid consumed by the maintenance and recovery operation.

BRIEF SUMMARY

In an aspect of this disclosure, there is provided an image forming apparatus including a recording head, a cap, a suction device, a suction controller, a dummy ejection controller, a first timer, and a second timer. The recording head has nozzles at a nozzle face thereof to eject droplets of liquid. The cap seals the nozzle face of the recording head. The suction device is connected to the cap to suck the liquid from the recording head. The suction controller seals the nozzle face of the recording head with the cap and drives the suction device to suck the liquid from the recording head to perform sucking operation. The dummy ejection controller ejects, from the recording head, droplets not contributing to image formation to perform dummy ejection. The first timer measures a first elapsed time after the dummy ejection controller performs the dummy ejection. The second timer measures a second elapsed time after the suction controller performs the sucking operation. A liquid discharge amount of the sucking operation is set to be greater than a liquid discharge amount of the dummy ejection. When the first elapsed time is equal to or greater than a first predetermined threshold time, the dummy ejection controller performs the dummy ejection. When the second elapsed time is equal to or greater than a second predetermined threshold time which is greater than the first predetermined threshold time, the suction controller performs the sucking operation.

In an aspect of this disclosure, there is provided an image forming apparatus including a recording head, a cap, a suction device, a suction controller, a dummy ejection controller, a first timer, a second timer, and a third timer. The recording head has nozzles at a nozzle face thereof to eject droplets of liquid. The cap seals the nozzle face of the recording head. The suction device is connected to the cap to suck the liquid from the recording head. The suction controller seals the nozzle face of the recording head with the cap and drives the suction device to suck the liquid from the recording head to perform sucking operation. The dummy ejection controller ejects, from the recording head, droplets not contributing to image formation to perform dummy ejection. The first timer measures a first elapsed time after the dummy ejection controller performs, as a first dummy ejection, the dummy ejection with a first predetermined liquid ejection amount. The second timer measures a second elapsed time after the dummy ejection controller performs, as a second dummy ejection, the dummy ejection with a second predetermined liquid ejection amount. The third timer measures a third elapsed time after the suction controller performs the sucking operation. A liquid discharge amount of the sucking operation is set to be greater than a liquid discharge amount of the second dummy ejection. When the first elapsed time is equal to or greater than a first predetermined threshold time and is less than a second predetermined threshold time, the dummy ejection controller performs the first dummy ejection. When the second elapsed time is equal to or greater than the second predetermined threshold time and is less than a third predetermined threshold time, the dummy ejection controller performs the second dummy ejection. When the third elapsed time is equal to or greater than the third predetermined threshold time, the suction controller performs the sucking operation.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 9 is a table of an example of maintenance and recovery operation performed during power-on and power-off periods of the image forming apparatus.

Figure 1:
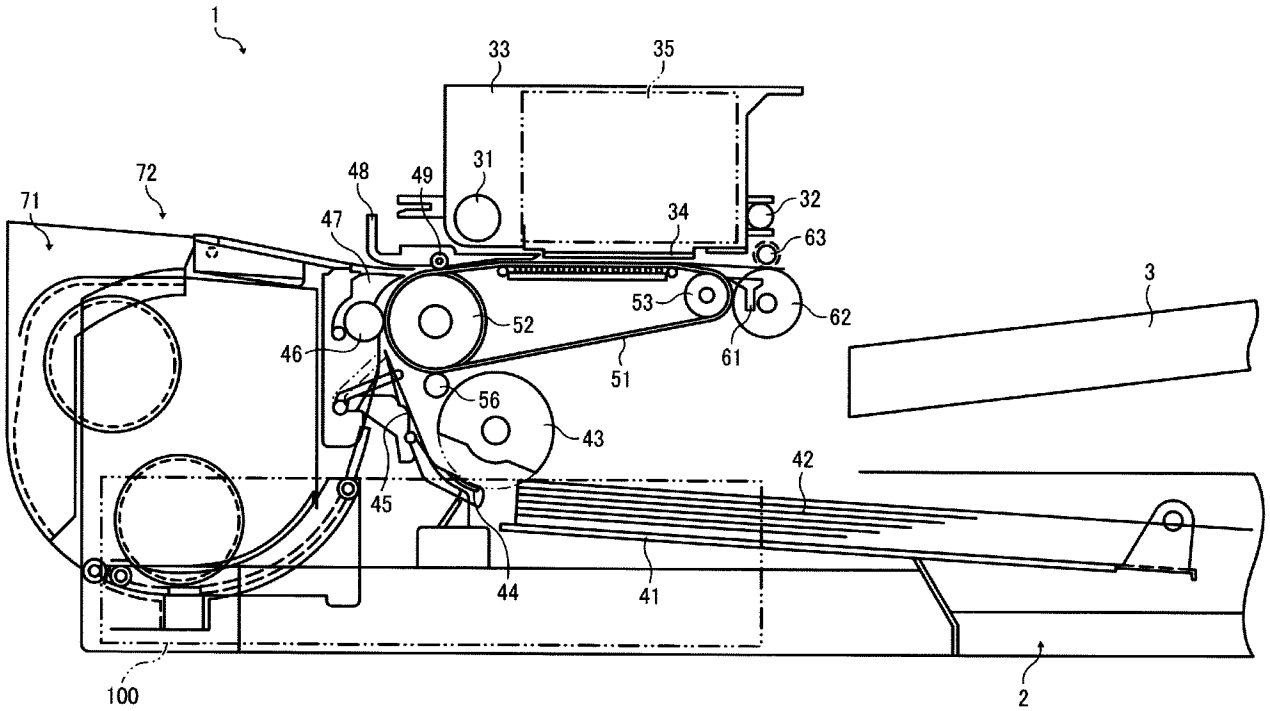
FIG. 1 is a side view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment is described below with reference to FIGS. 1 and 2.

Figure 2:
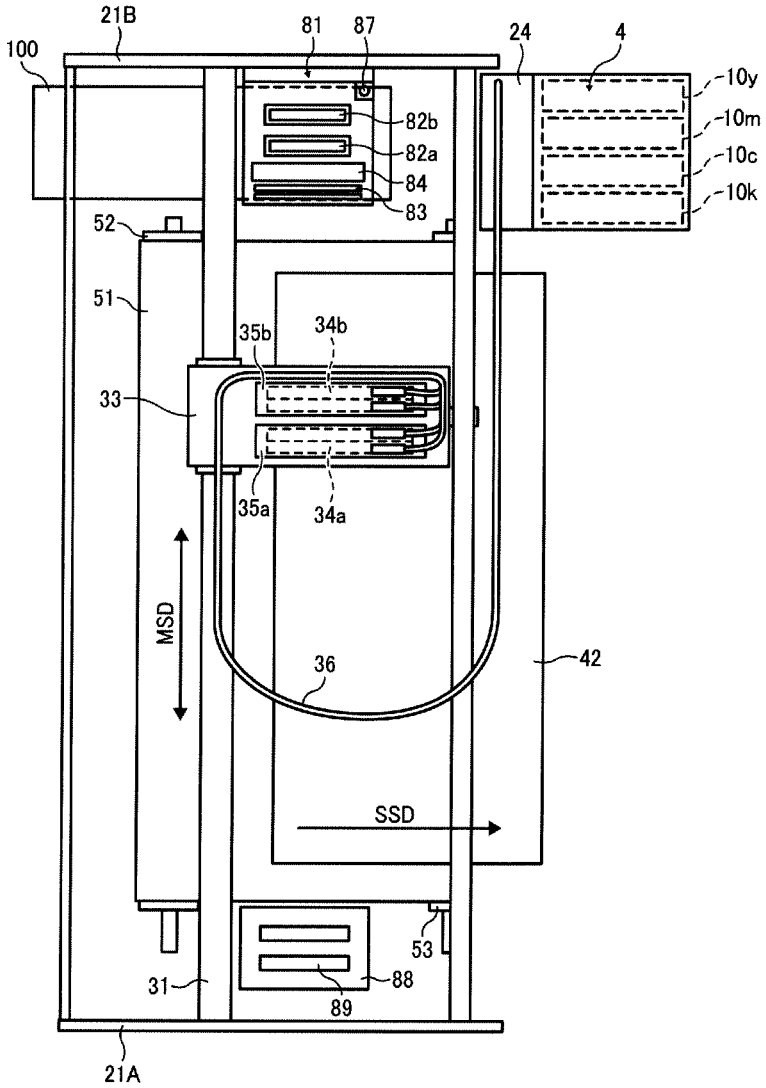
FIG. 2 is a partial plan view of the mechanical section illustrated in FIG. 1.

FIG. 1 is a side view of an entire configuration of the image forming apparatus. FIG. 2 is a partial plan view of the image forming apparatus of FIG. 1.

In this exemplary embodiment, the image forming apparatus is described as a serial-type inkjet recording apparatus. In the image forming apparatus, a carriage 33 is supported by a main guide rod 31 and a sub guide rod 32 so as to be slidable in a main scanning direction indicated by an arrow MSD in FIG. 2. The main guide rod 31 and the sub guide rod 32 serving as guide members extend between a left side plate 21A and a right side plate 21B of an apparatus body 1. The carriage 33 is reciprocally moved for scanning in the main scanning direction MSD by a main scanning motor via a timing belt The carriage 33 mounts recording heads 34*a* and 34*b* (collectively referred to as "recording heads 34" unless distinguished) formed with liquid ejection heads for ejecting ink droplets of different colors, e.g., yellow (Y), cyan (C), magenta (M), and black (K). The recording heads 34*a* and 34*b* are mounted on the carriage 33 so that multiple nozzle rows, each of which including multiple nozzles, are arranged in parallel to a direction (sub-scanning direction) perpendicular to the main scanning direction and liquid droplets are ejected downward from the nozzles.

For example, each of the recording heads 34 has two nozzle rows. In such a case, for example, one of the nozzle rows of the recording head 34*a* ejects droplets of black (K) ink and the other ejects droplets of cyan (C) ink. In addition, one of the nozzles rows of the recording head 34*b* ejects droplets of magenta (M) ink and the other ejects droplets of yellow (Y) ink.

The carriage 33 also mounts head tanks 35*a* and 35*b* (collectively referred to as "head tanks 35" unless distinguished) to supply the different color inks to the respective nozzle rows of the recording heads 34. A supply pump unit 24 supplies (replenishes) the respective color inks from ink cartridges (main tanks) 10*y*, 10*m*, 10*c*, and 10*k* removably mountable in a cartridge mount portion 4 to the head tanks 35 via ink supply tubes 36 dedicated for the respective color inks.

The image forming apparatus further includes a sheet feed section to feed sheets 42 stacked on a sheet stack portion (platen) 41 of a sheet feed tray 2. The sheet feed section further includes a sheet feed roller 43 of, e.g., semi-circular shape to separate the sheets 42 from the sheet stack portion 41 and feed the sheets 42 sheet by sheet and a separation pad 44 disposed facing the sheet feed roller 43. The separation pad 44 is made of a material of a high friction coefficient and urged toward the sheet feed roller 43.

To feed the sheets 42 from the sheet feed section to a position below the recording heads 34, the image forming apparatus includes a first guide member 45 to guide the sheet 42, a counter roller 46, a conveyance guide member 47, a press member 48 including a front-end press roller 49, and a conveyance belt 51 to convey the sheet 42 to a position opposing the recording heads 34 with the sheet 42 electrostatically attracted thereon.

The conveyance belt 51 is an endless belt that is looped between a conveyance roller 52 and a tension roller 53 so as to circulate in a belt conveyance direction (sub-scanning direction). A charging roller 56 serving as a charging device is provided to charge a surface of the conveyance belt 51. The charging roller 56 is disposed so as to contact the surface of the conveyance belt 51 and rotate with the circulation of the conveyance belt 51. The conveyance roller 52 is circulated by a sub-scanning motor via a timing belt, so that the conveyance belt 51 circulates in the belt conveyance direction, i.e., the sub-scanning direction SSD illustrated in FIG. 2.

The image forming apparatus further includes a sheet output section to output the sheet 42 on which an image has been formed by the recording heads 34. The sheet output section includes a separation claw 61 to separate the sheet 42 from the conveyance belt 51, a first output roller 62, a second output roller 63, and a sheet output tray 3 disposed below the first output roller 62.

A duplex unit 71 is detachably mounted on a rear face portion of the apparatus body 1. When the conveyance belt 51 circulates in reverse to return the sheet 42, the duplex unit 71 receives the sheet 42. Then the duplex unit 71 turns the sheet 42 upside down to feed the sheet 42 between the counter roller 46 and the conveyance belt 51. A manual-feed tray 72 is formed at the top face of the duplex unit 71.

A maintenance device 81 (maintenance-and-recovery device) is disposed in a non-printing area (non-recording area) at one end in the main-scanning direction of the carriage 33. The maintenance device 81 maintains and recovers nozzle conditions of the recording heads 34. The maintenance device 81 includes caps (cap members) 82*a* and 82*b* (hereinafter collectively referred to as "caps 82" unless distinguished) to cover the nozzle faces of the recording heads 34, a wiper member (wiper blade) 83 to wipe the nozzle faces of the recording heads 34, a first dummy ejection receptacle 84 to receive liquid droplets ejected by dummy ejection in which liquid droplets not contributing to recording are ejected to remove viscosity-increased recording liquid, and a carriage lock 87 to lock the carriage 33. Below the maintenance device 81, a waste liquid tank 100 is removably mounted to the apparatus body 1 to store waste ink or liquid generated by the maintenance and recovery operation.

A second dummy ejection receptacle 88 is disposed at a non-recording area on the other end in the main scanning direction of the carriage 33. The second dummy ejection receptacle 88 receives liquid droplets ejected by dummy ejection in which liquid droplets not contributing to recording are ejected to remove viscosity-increased recording liquid during, e.g., recording (image forming) operation. The second dummy ejection receptacle 88 has openings 89 arranged in parallel with the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed between the conveyance belt 51 and the counter roller 46. Further, the front end of the sheet 51 is guided along the conveyance guide member 47 and pressed against the conveyance belt 51 by the front-end press roller 49 to turn the traveling direction of the sheet 42 by approximately 90°.

At this time, alternating voltages are applied to the charging roller 56 so that plus outputs and minus outputs are alternately repeated. As a result, the conveyance belt 51 is charged with an alternating charged voltage pattern, that is, an alternating band pattern of positively-charged areas and negatively-charged areas in the sub-scanning direction SSD, i.e., the belt circulation direction. When the sheet 42 is fed onto the conveyance belt 51 alternately charged with positive and negative voltages, the sheet 42 is attached on the conveyance belt 51 by electrostatic force and conveyed in the sub scanning direction by the circulation of the conveyance belt 51.

By driving the recording heads 34 in response to image signals while moving the carriage 33, ink droplets are ejected onto the sheet 42, which is stopped below the recording heads 34, to form one line of a desired image. Then, the sheet 42 is fed by a certain distance to prepare for the next operation to record another line of the image. Receiving a signal indicating that the image recording has been completed or the rear end of the sheet 42 has arrived at the recording area, the recording heads 34 finish the recording operation and the sheet 42 is output to the sheet output tray 3.

To perform maintenance-and-recovery operation of the nozzles of the recording heads 34, the carriage 33 is moved to a home position at which the carriage 33 opposes the maintenance device 81. Then, maintenance-and-recovery operation, such as nozzle sucking operation for suctioning ink from nozzles with the nozzle face of the recording heads 34 covered with the caps 82 and/or dummy ejection for ejecting liquid droplets not contributed to image formation, is performed, thus allowing image formation with stable droplet ejection.

Figure 3:
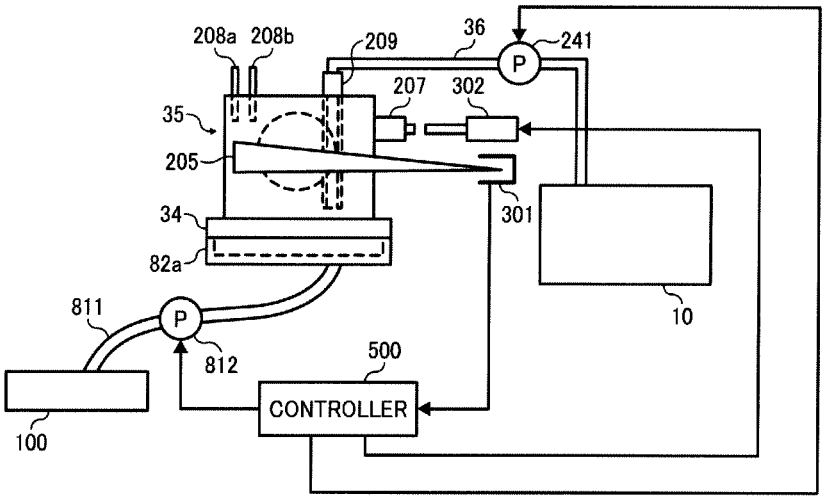
FIG. 3 is a schematic view of an ink supply-and-discharge system.

Next, the ink supply-and-discharge system is described with reference to FIG. 3.

Ink supply from the ink cartridges (main tanks) 10 to the head tanks 35 is performed by a liquid feed pump 241 serving as a liquid feed device of the supply pump unit 24 via the supply tubes 36. The liquid feed pump 241 is a reversible pump formed with a tube pump and can perform both normal feed operation to supply ink from the ink cartridges 10 to the head tanks 35 and reverse feed operation to return ink from the head tanks 35 toward the ink cartridges 10.

As described above, the maintenance device 81 has the cap 82*a* to cap the nozzle face of one of the recording heads 34 and a suction pump 812 connected to the cap 82*a*. By driving the suction pump 812 with the nozzle face capped with the cap 82*a*, ink is sucked from nozzles via a suction tube 811, thus allowing ink to be sucked from the head tanks 35 Sucked ink is discharged as waste liquid to the waste liquid tank 100. The dummy ejection can be performed to the cap 82*a*, and in such a case, waste liquid ejected by the dummy ejection is discharged to the waste liquid tank 100.

At the apparatus body 1 is disposed an air release solenoid 302 serving as a pressing member to open and close an air release assembly 207 of the head tank 35. The air release assembly 207 can be opened by activating the air release solenoid 302. A detection sensor 301 serving as an optical sensor to detect a detection filler 205 of the head tank 35 is disposed at the apparatus body 1.

Next, a controller of the image forming apparatus is described with reference to FIG. 4.

Figure 4:
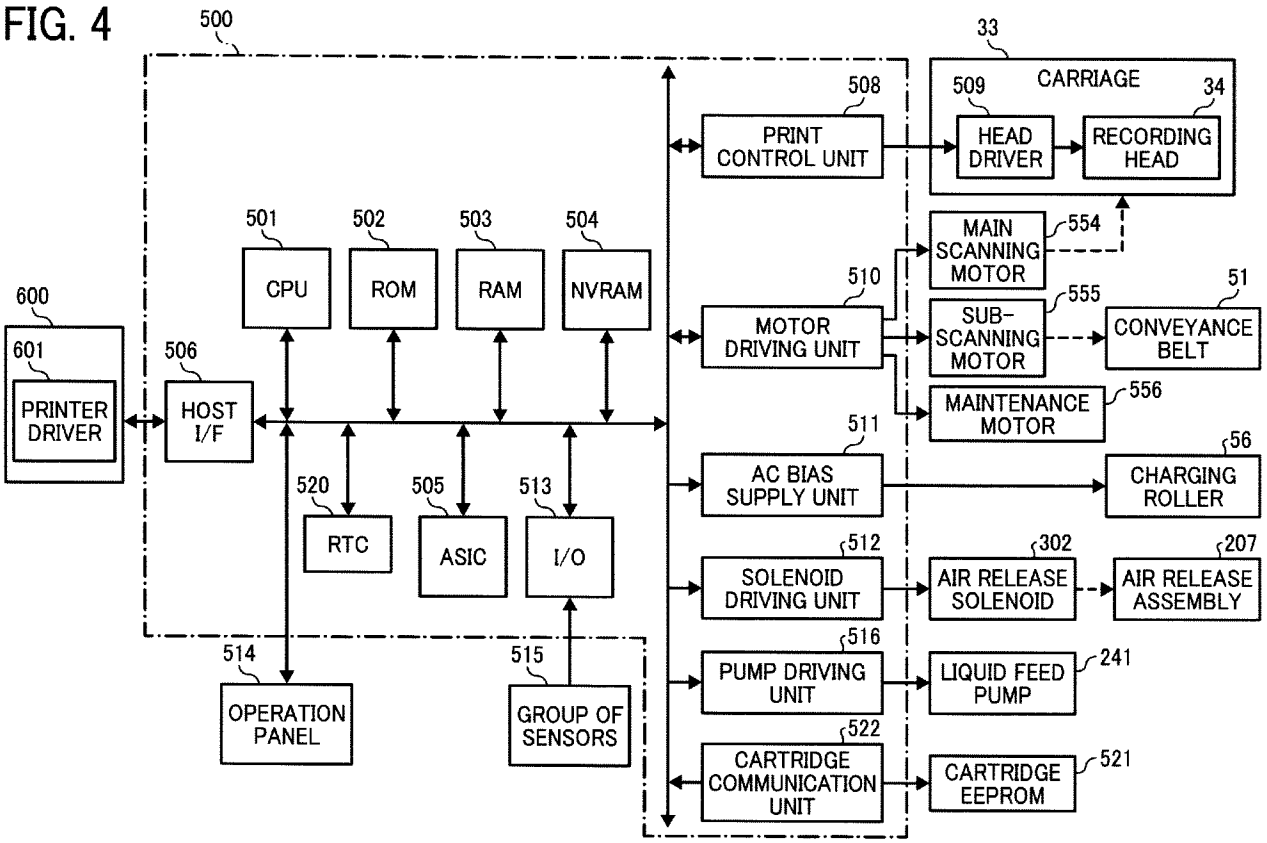
FIG. 4 is a schematic block diagram of a controller of the image forming apparatus.

FIG. 4 is a block diagram of the controller.

The controller 500 includes a central processing unit (CPU) 501, programs, a read-only memory (ROM) 502, a random access memory (RAM) 503, a non-volatile random access memory (NVRAM) 504, and an application-specific integrated circuit (ASIC) 505. The CPU 511 generally controls the image forming apparatus. The programs include control programs to cause the CPU 501 to execute control operations (sucking control and dummy ejection control) according to exemplary embodiments of this disclosure. The ROM 502 stores other fixed data, and the RAM 503 temporarily stores image and other data. The non-volatile memory 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver IC) 509, a main scanning motor 554, a sub-scanning motor 555, a motor driving unit 510, and an alternating current (AC) bias supply unit 511, a solenoid driving unit 512, a pump driving unit 516, and a cartridge communication unit 522. The print control unit 508 includes a data transfer section and a driving signal generating section to drive and control the recording heads 34. The head driver 509 is disposed at the carriage 33 to drive the recording heads 34. The main scanning motor 554 moves the carriage 33 for scanning, and the sub-scanning motor 555 circulates the conveyance roller 51. The motor driving unit 510 drives a maintenance motor 556 of the maintenance device 81. The AC bias supply unit 511 supplies an AC bias to the charging roller 56. The solenoid driving unit 512 drives the air release solenoid 302 to open and close the air release assembly 207 of each head tank 35. The pump driving unit 516 drives the liquid feed pump 241. The cartridge communication unit 522 is mounted in the ink cartridges 10 to perform communication to read and write data from and on a non-volatile memory, in this case, cartridge electrically erasable and programmable ROM (cartridge EEPROM) 521.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), an image reading device (e.g., image scanner), or an imaging device (e.g., digital camera), via a cable or network.

The CPU 501 of the controller 500 reads and analyzes print data stored in a reception buffer of the I/F 506, performs desired image processing, data sorting, or other processing with the ASIC 505, and transfers image data to the head driver 509. Dot-pattern data for image output is created by, e.g., a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generating section including, e.g., a voltage amplifier, a current amplifier, and a digital/analog (D/A) converter to convert pattern data stored in the ROM 502 from digital data to analog data, and outputs a driving signal containing one or more driving pulses to the head driver 509.

In accordance with serially-inputted image data corresponding to one image line recorded by the recording heads 34, the head driver 509 selects driving pulses of a driving waveform transmitted from the print control unit 508 and applies the selected driving pulses to the driving elements (e.g., piezoelectric elements) to drive the recording heads 34. Thus, the driving elements generate energy to eject liquid droplets from the recording heads 34. At this time, by selecting one or more of the driving pulses forming the driving waveform, the recording heads 34 can selectively eject, e.g., large droplets, middle droplets, and small droplets to form different sizes of dots on the sheet.

An input/output unit 513 acquires information from a group of sensors 515 mounted in the image forming apparatus, extracts information required for controlling printing operation, and controls the print control unit 508, the motor driving unit 510, and the AC bias supply unit 511 based on the extracted information. The group of sensors 515 includes, for example, an optical sensor to detect a position of the sheet, a thermistor to monitor temperature and humidity in the apparatus, a sensor to monitor the voltage of a charging belt, and an interlock switch to detect the opening and closing of a cover. The I/O unit 513 is capable of processing information from such various types of sensors. To the input/output unit 513 to which information is input from the group of sensors 515, signals are also input from detection electrode pins 208*a* and 208*b* and the detection sensor 301 to detect the detection filler 205 of the head tanks 35.

The controller 500 further includes a real time clock (RTC) 520 serving as a time measuring device to measure time.

Next, elements of the controller involving maintenance and recovery operation are described with reference to FIG. 5.

First, in this exemplary embodiment, first dummy ejection, second dummy ejection, and cleaning operation are performed as the maintenance and recovery operation. For the first dummy ejection, a first predetermined amount (first dummy ejection amount) of ink is ejected from the recording heads 34 to the first dummy ejection receptacle 84 or the cap 82*a*. For the second dummy ejection, a second predetermined amount (second dummy ejection amount) of ink is ejected from the recording heads 34 to the first dummy ejection receptacle 84 or the cap 82*a*. For the cleaning operation, with the nozzle face of one of the recording heads 34 covered with the cap 82*a*, the suction pump 812 of the maintenance device 81 is driven to suck ink from the nozzles of the recording heads 34.

The dummy ejection amount can be determined based on the number or volume of droplets ejected by dummy ejection. The liquid discharge amount of the cleaning operation is set to be greater than the liquid discharge amount (second dummy ejection amount) of the second dummy ejection.

Figure 5:
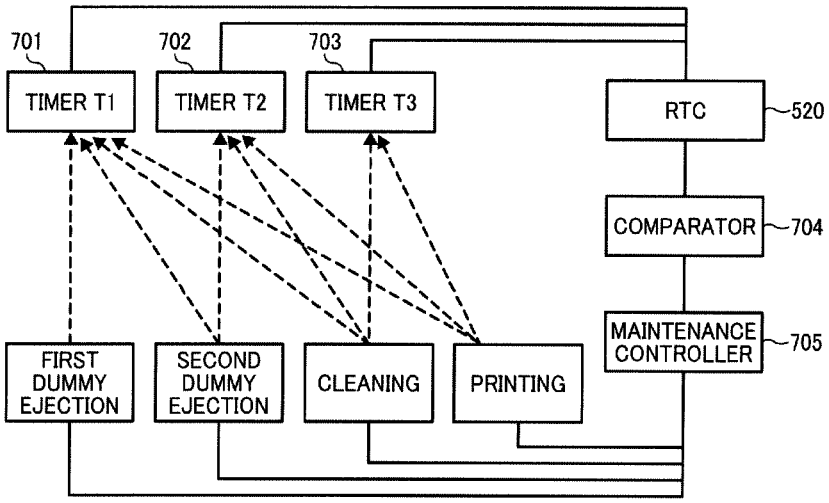
FIG. 5 is a block diagram of elements involving maintenance and recovery operation.

In FIG. 5, a timer 701 is a first timer to measure a first elapsed time T1 after the first dummy ejection is performed at the first dummy ejection amount. A timer 702 is a second timer to measure a second elapsed time T2 after the second dummy ejection is performed at the second dummy ejection amount greater than the first dummy ejection amount. A timer 703 is a third timer to measure a third elapsed time T3 after the cleaning operation is performed. The timers 701, 702, and 703 read a current time from the RTC 520 to measure the elapsed times T1, T2, and T3, respectively.

A comparator 704 compares the first to third elapsed times T1 to T3 measured by the timers 701 to 703 with first to third predetermined threshold times t1 to t3, respectively, to pass comparison results to printing process and a maintenance controller 705.

The maintenance controller 705 also serves as a suction controller and a dummy ejection controller. Based on the comparison results of the comparator 704, the maintenance controller 705 controls the first dummy ejection, the second dummy ejection, and the cleaning operation and resets a corresponding one of the timers 701 to 703 after the first dummy ejection, the second dummy ejection, or the cleaning operation is performed. The maintenance controller 705 also resets the timers 701 to 703 after printing is performed.

Next, control of the maintenance and recovery operation is described with reference to FIG. 6.

Figure 6:
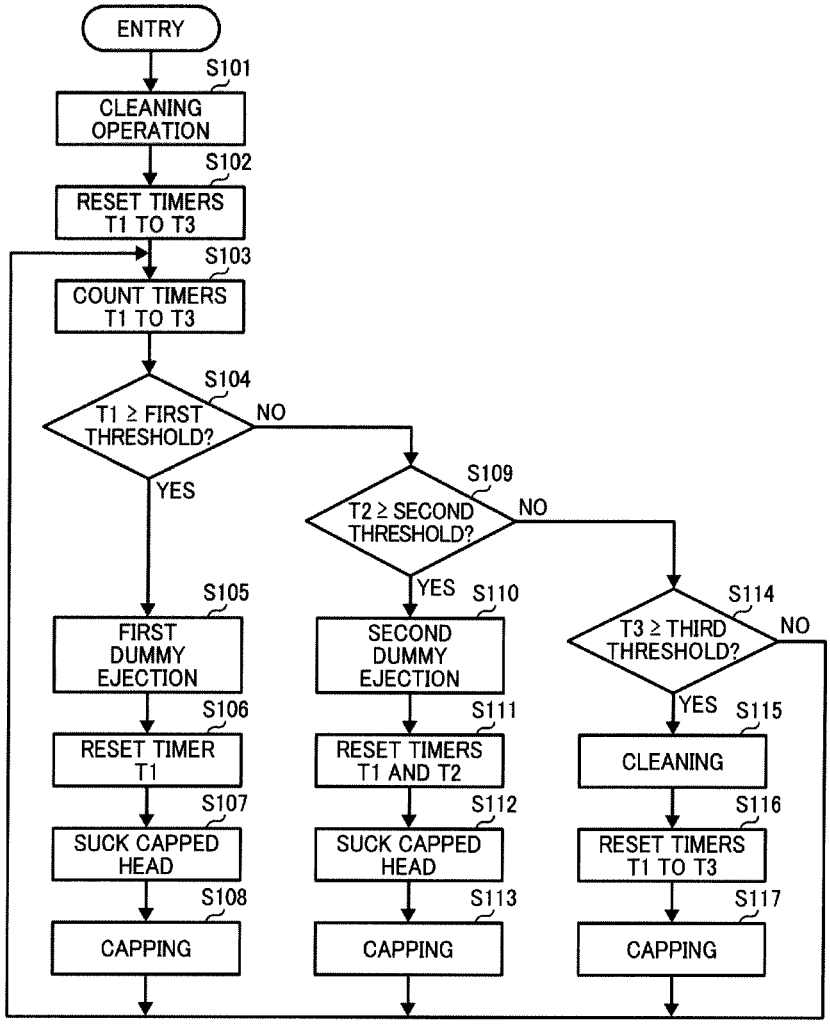
FIG. 6 is a flowchart of a control procedure of the maintenance and recovery operation.

In FIG. 6, the timer 701, the timer 702, and the timer 703 are denoted as timer T1, timer T2, timer T3, respectively, for ease of understanding.

When the cleaning operation is performed at S101, the timers 701 to 703 are reset at S102 to reset the elapsed times T1 to T3. At 5103, the timers 701 to 703 start counting to start measuring the elapsed times T1 to T3, respectively.

At S104, it is determined whether or not the first elapsed time T1 measured by the timer 701 is the first threshold time t1 or greater (T1

If the first elapsed time T1 is the first threshold time t1 or greater (YES at S104), at S105 the first dummy ejection is performed to eject ink to the cap 82*a*. At S106, the timer 701 (the first elapsed time T1) is reset, and at S107 ink is sucked and discharged from the cap 82*a*. At S108, the recording head 34 is capped with the cap 82*a* again.

By contrast, if the first elapsed time T1 is less than the first threshold time t1 (NO at S104), at S109 it is determined whether or not the second elapsed time T2 measured by the timer 702 is the second threshold time t2 (t2>t1) or greater (T2≥t2).

If the second elapsed time T2 is the second threshold time t2 or greater (YES at S109), at S110 the second dummy ejection is performed to eject ink to the cap 82*a*. At S111, the timers 701 and 702 (the first and second elapsed times T1 and T2) are reset, and at S112 ink is sucked and discharged from the cap 82*a*. At S113, the recording head 34 is capped with the cap 82*a* again.

By contrast, if the second elapsed time T2 is less than the second threshold time t2 (NO at S109), at S114 it is determined whether or not the third elapsed time T3 measured by the timer 703 is the third threshold time t3 (t3>t2) or greater (T3≥t3).

If the third elapsed time T3 is the third threshold time t3 or greater (YES at S114), at S115 the cleaning operation is performed with the recording head 34 capped with the cap 82*a*. At S116, the timers 701 to 703 (the first to third elapsed times T1 to T3) are reset, and at S117 the recording head 34 is capped with the cap 82*a* again.

In other words, the timer 701 measures the first elapsed time T1 after the first dummy ejection is performed. The timer 702 measures the second elapsed time T2 after the second dummy ejection is performed. The timer 703 measures the third elapsed time T3 after the cleaning operation is performed. The measurement of the elapsed times is performed on each of the recording heads 34.

The first threshold time t1 is set to be shorter than the second threshold time t2, and the second threshold time t2 is set to be shorter than the third threshold time t3.

Hence, the elapsed times T1 to T3 measured by the timers 701 to 703 are compared with the first to third threshold times t1 to t3, respectively. If the first elapsed time T1 measured by the timer 701 is the first threshold time t1 or greater and is less than the second threshold time t2, the first dummy ejection is performed and the first elapsed time T1 is reset. If the second elapsed time T2 measured by the timer 702 is the second threshold time t2 or greater and is less than the third threshold time t3, the second dummy ejection is performed and the first and second elapsed times T1 and T2 are reset. If the third elapsed time T3 measured by the timer 703 is the third threshold time t3 or greater, the cleaning operation is performed and the first to third elapsed times T1 to T3 are reset.

In addition, when printing operation or cleaning operation caused by other factors than the elapsed time is performed, the first to third elapsed times T1 to T3 measured by the timers T1 to T3 are reset. In other words, if printing is repeatedly performed when the elapsed time is less than the first threshold time t1, the elapsed times T1 to T3 are reset before the elapsed times T1 to T3 exceed the first to third threshold times t1 to t3, respectively. As a result, the maintenance and recovery operation according to the above-described elapsed time is not performed.

When the first dummy ejection, the second dummy ejection, or the cleaning operation is performed, it may be determined whether or not the negative pressure in each head tank 35 is normally maintained, thus allowing regular inspection of the internal state of each head tank 35. Whether or not the negative pressure in each head tank 35 is normally maintained can be determined by, for example, a conductive state of the electrode pins 208*a* and 208*b* of each head tank 35 or detection of the detection filler 205 at a predetermined threshold position or higher.

Next, another example of execution timing of the maintenance and recovery operation is described with reference to FIGS. 7 and 8.

Figure 7:
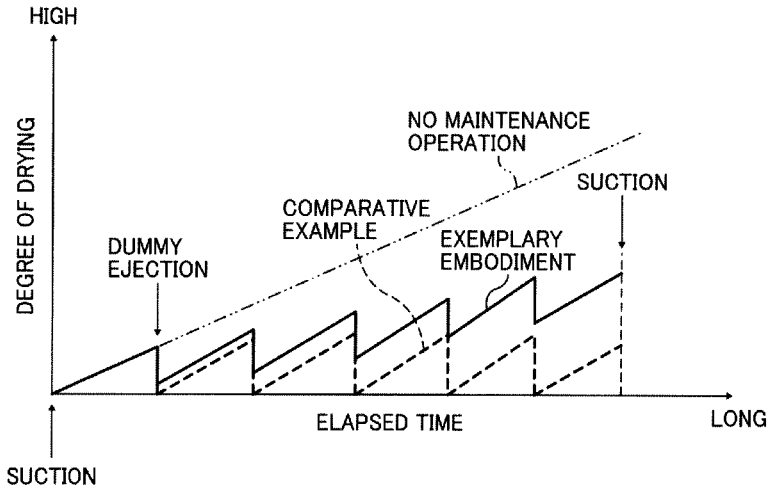
FIG. 7 is a chart showing an example of execution timing of the maintenance and recovery operation.
Figure 8:
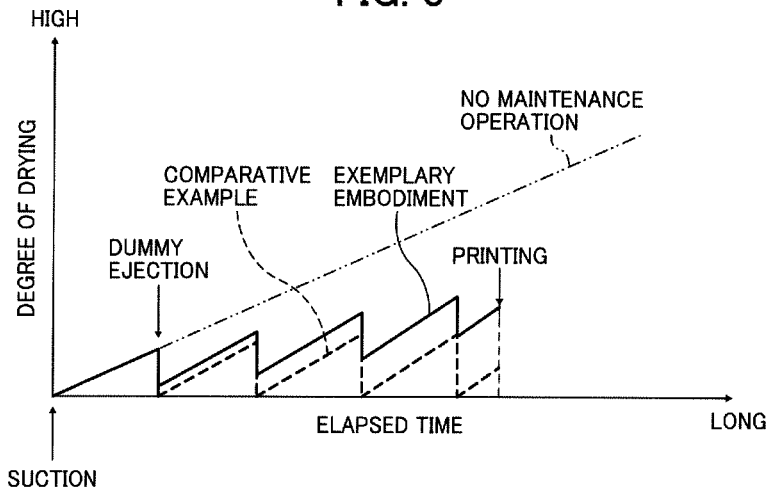
FIG. 8 is a chart showing another example of execution timing of the maintenance and recovery operation.

In FIGS. 7 and 8, this exemplary embodiment is indicated by solid line and a comparative example is indicated by broken line. For the comparative example, the dummy ejection amount (amount of ink ejected per dummy ejection) is set to be an amount sufficient to restore the degree of drying of ink to an original state. By contrast, in this exemplary embodiment, the dummy ejection amount is set to be smaller than, for example, 0.8 times as small as that of the comparative example.

Here, for ease of description, it is assumed that the above-described second dummy ejection is not performed. In the example of FIG. 7, when the first dummy ejection is performed five times and the elapsed time from the end of previous cleaning operation is the third threshold time or greater, cleaning operation is performed. In the example of FIG. 8, when the first dummy ejection is performed four times and the elapsed time from the end of previous cleaning operation is less than the third threshold time, a printing instruction is issued to perform printing operation.

As a result, for the comparative example, each time the dummy ejection is performed, the degree of drying of ink is restored to the original state. By contrast, for this exemplary embodiment, even when dummy ejection is performed, the degree of drying of ink may increase over time. However, the amount of liquid consumed in this exemplary embodiment is 0.8 times as small as that of the comparative example, thus reducing the amount of liquid consumed. In this exemplary embodiment, the degree of drying of ink in nozzles of the recording head 34 before printing may be relatively high. However, if the degree of drying of ink is in a range not affecting image quality, ink drying is not problematic. Hence, in this exemplary embodiment, the amount of ink ejected by dummy ejection can be set to be such a value that the degree of drying of ink is in such a range not affecting image quality.

In addition, when printing is performed, droplets are ejected to the sheet and regular dummy ejection during printing are performed. As a result, since the degree of drying of nozzles over time is reset, the elapsed times T1 to T3 are reset after printing is finished.

As described above, the amount (liquid discharge amount) of liquid discharged by the second dummy ejection is greater than the amount of ink discharged by the first dummy ejection. The amount of liquid discharged by sucking operation (cleaning operation) is greater than the amount (dummy ejection amount) of liquid discharged by the second dummy ejection. Hence, the second threshold time is set to be not less than a value obtained by multiplying the first threshold time by a ratio of the second dummy ejection amount to the first dummy ejection amount.

For example, if the second dummy ejection amount is 1.5 times as much as the first dummy ejection amount, the second threshold time is set to be not less than 1.5 times as much as the first threshold time. Likewise, the third threshold time is set to be not less than a value obtained by multiplying the first threshold time by a ratio of the liquid discharge amount of the cleaning operation to the first dummy ejection amount. Each of the second threshold time and the third threshold time is preferably not less than twice as much as the first threshold time.

In a case in which the dummy ejection amount is changed according to detection results of an environmental sensor (e.g., a temperature sensor), the threshold time is also preferably changed according to the detection results.

Next, an example of the maintenance and recovery operation performed during power-on and power-off periods of the image forming apparatus is described with reference to FIG. 9.

Since the execution timing of printing is different between the power-on period and the power-off period, the total operation according to the elapsed time is also different between the power-on period and the power-off period.

For the power-on period, so that printing can be performed at any timing, the first dummy ejection is performed when a measurement result of the elapsed time T1 passes the first threshold time t1, the second dummy ejection is performed when a measurement result of the elapsed time T2 passes the second threshold time t2, and the cleaning operation is performed when the elapsed time T3 passes the third threshold time t3.

For example, in a case in which a relation of t3=2×t2=4×t1 is satisfied, when the first elapsed time T1 passes the first threshold time t1, the first dummy ejection is performed once as the total operation. When the second elapsed time T2 passes the second threshold time t2, each of the first dummy ejection and the second dummy ejection is performed once in the total operation. When the third elapsed time T3 passes the third threshold time t3, the first dummy ejection, the second dummy ejection, and the cleaning operation are performed twice, once, and once, respectively, in the total operation.

For the power-off period, at the power on of the apparatus, if the elapsed time T1 measured by the timer 701 is the first threshold time t1 or greater and is less than the second threshold time t2, the first dummy ejection is performed. Alternatively, at the power on of the apparatus, if the elapsed time T2 measured by the timer 702 is the second threshold time t2 or greater and is less than the third threshold time t3, the second dummy ejection is performed. If the elapsed time T3 measured by the timer 703 is the third threshold time t3 or greater, the cleaning operation is performed.

Since a greater liquid discharge amount of operation is prioritized over a smaller liquid discharge amount of operation, when the second dummy ejection is performed, the first dummy ejection is not performed. When the cleaning operation is performed, the first and second dummy ejections are not performed.

For example, in a case in which a relation of t3=2×t2=4×t1 is satisfied, when the first elapsed time T1 passes the first threshold time t1, the first dummy ejection is performed once as the total operation. When the second elapsed time T2 passes the second threshold time t2, the second dummy ejection is performed once as the total operation. When the third elapsed time T3 passes the third threshold time t3, the cleaning operation is performed once as the total operation.

In the above-described exemplary embodiment, two types of dummy ejection, i.e., the first dummy ejection and the second dummy ejection different in the dummy ejection amount are performed. Alternatively, for example, only one type of dummy ejection may be performed.

In such a case, the first timer measures, as a first elapsed time, an elapsed time after the dummy ejection is performed, and the second timer measures, as a second elapsed time, an elapsed time after the sucking operation is performed. The amount of liquid discharged by the sucking operation is set to be greater than the amount of liquid discharged by the dummy ejection. When the first elapsed time is a first predetermined threshold time or greater, the dummy ejection is performed. When the second elapsed time is a second predetermined threshold time or greater, the sucking operation is performed.

Likewise, the second threshold time is preferably set to be not less than a value obtained by multiplying the first threshold time by a ratio of the liquid discharge amount of the sucking operation to the liquid discharge amount of the dummy ejection. In addition, the second threshold time is preferably set to be not less than twice as much as the value obtained by multiplying the first threshold time by the ratio of the liquid discharge amount of the sucking operation to the liquid discharge amount of the dummy ejection.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having nozzles at a nozzle face thereof to eject droplets of liquid;

a cap to seal the nozzle face of the recording head;

a suction device connected to the cap to suck the liquid from the recording head;

a suction controller to seal the nozzle face of the recording head with the cap and drive the suction device to suck the liquid from the recording head to perform sucking operation;

a dummy ejection controller to eject, from the recording head, droplets not contributing to image formation to perform dummy ejection;

a first timer to measure a first elapsed time after the dummy ejection controller performs the dummy ejection; and a second timer to measure a second elapsed time after the suction controller performs the sucking operation;

wherein a liquid discharge amount of the sucking operation is set to be greater than a liquid discharge amount of the dummy ejection, when the first elapsed time is equal to or greater than a first predetermined threshold time, the dummy ejection controller performs the dummy ejection, and when the second elapsed time is equal to or greater than a second predetermined threshold time which is greater than the first predetermined threshold time, the suction controller performs the sucking operation.

2. The image forming apparatus of claim 1, wherein, after the dummy ejection controller performs the dummy ejection, a measurement result of the first timer is reset, and after the suction controller performs the sucking operation, measurement results of the first timer and the second timer are reset.

3. The image forming apparatus of claim 1, wherein the second predetermined threshold time is not less than a time obtained by multiplying the first predetermined threshold time by a ratio of the liquid discharge amount of the sucking operation to the liquid discharge amount of the dummy ejection.

4. The image forming apparatus of claim 3, wherein the second predetermined threshold time is not less than twice as much as the time obtained by multiplying the first predetermined threshold time by the ratio of the liquid discharge amount of the sucking operation to the liquid discharge amount of the dummy ejection.

5. An image forming apparatus comprising:

a recording head having nozzles at a nozzle face thereof to eject droplets of liquid;

a cap to seal the nozzle face of the recording head;

a suction device connected to the cap to suck the liquid from the recording head;

a suction controller to seal the nozzle face of the recording head with the cap and drive the suction device to suck the liquid from the recording head to perform sucking operation;

a dummy ejection controller to eject, from the recording head, droplets not contributing to image formation to perform dummy ejection;

a first timer to measure a first elapsed time after the dummy ejection controller performs, as a first dummy ejection, the dummy ejection with a first predetermined liquid ejection amount;

a second timer to measure a second elapsed time after the dummy ejection controller performs, as a second dummy ejection, the dummy ejection with a second predetermined liquid ejection amount; and a third timer to measure a third elapsed time after the suction controller performs the sucking operation;

wherein a liquid discharge amount of the sucking operation is set to be greater than a liquid discharge amount of the second dummy ejection, when the first elapsed time is equal to or greater than a first predetermined threshold time and is less than a second predetermined threshold time, the dummy ejection controller performs the first dummy ejection, when the second elapsed time is equal to or greater than the second predetermined threshold time and is less than a third predetermined threshold time, the dummy ejection controller performs the second dummy ejection, and when the third elapsed time is equal to or greater than the third predetermined threshold time, the suction controller performs the sucking operation.

6. The image forming apparatus of claim 5, wherein, after the dummy ejection controller performs the first dummy ejection, a measurement result of the first timer is reset, after the dummy ejection controller performs the second dummy ejection, measurement results of the first timer and the second timer are reset, and after the suction controller performs the sucking operation, measurement results of the first timer, the second timer, and the third timer are reset.

7. The image forming apparatus of claim 5, wherein the second predetermined threshold time is not less than a time obtained by multiplying the first predetermined threshold time by a ratio of the liquid discharge amount of the second dummy ejection to the liquid discharge amount of the first dummy ejection, and the third predetermined threshold time is not less than a time obtained by multiplying the first predetermined threshold time by a ratio of the liquid discharge amount of the sucking operation to the liquid discharge amount of the first dummy ejection.

8. The image forming apparatus of claim 7, wherein the second predetermined threshold time is not less than twice as much as the time obtained by multiplying the first predetermined threshold time by the ratio of the liquid discharge amount of the second dummy ejection to the liquid discharge amount of the first dummy ejection, and the third predetermined threshold time is not less than twice as much as the time obtained by multiplying the first predetermined threshold time by the ratio of the liquid discharge amount of the sucking operation to the liquid discharge amount of the first dummy ejection.

* * * * *